US006148443A

United States Patent [19]

Maastricht

[11] Patent Number: 6,148,443

[45] Date of Patent: Nov. 21, 2000

[54] LOWER BODY GOLF UTILITY GARMENT

[76] Inventor: Eileen A. Maastricht, 1521 N. Hudson, Chicago, Ill. 60610

[21] Appl. No.: 09/326,012

[22] Filed: Jun. 4, 1999

[51] Int. Cl.[7] ..... A41D 1/06

[52] U.S. Cl. ..... 2/69; 2/227

[58] Field of Search ..... 2/69, 70, 79, 47, 2/920, 227, 247

[56] References Cited

U.S. PATENT DOCUMENTS

| | | | |
|---|---|---|---|
| D. 360,595 | 7/1995 | Lia . | |
| 3,320,620 | 5/1967 | Weidler et al. | 2/69 |
| 3,387,392 | 6/1968 | Kurz | 35/32 |
| 3,811,205 | 5/1974 | Pitzler | 35/32 |
| 3,968,522 | 7/1976 | Riess . | |
| 4,129,237 | 12/1978 | Grinder . | |
| 4,210,093 | 7/1980 | Baker . | |
| 4,336,940 | 6/1982 | Sprague . | |
| 4,530,500 | 7/1985 | Kaymen . | |
| 4,625,862 | 12/1986 | Clayton . | |
| 4,736,877 | 4/1988 | Clark . | |
| 4,864,592 | 9/1989 | Lee . | |
| 4,886,196 | 12/1989 | Plummer . | |
| 4,893,739 | 1/1990 | Conner . | |
| 4,912,307 | 3/1990 | Shade et al. . | |
| 4,922,850 | 5/1990 | Conley . | |
| 4,998,726 | 3/1991 | Budnick . | |
| 5,056,697 | 10/1991 | Sheffield . | |
| 5,135,220 | 8/1992 | Baldoni . | |
| 5,282,616 | 2/1994 | Stacavich-Notaro . | |
| 5,471,191 | 11/1995 | Narita . | |
| 5,494,202 | 2/1996 | Wyatt . | |
| 5,517,696 | 5/1996 | Krugler | 2/250 |
| 5,550,884 | 8/1996 | Berney . | |
| 5,569,103 | 10/1996 | Sihn . | |

*Primary Examiner*—Bibhu Mohanty
*Attorney, Agent, or Firm*—James P. Murphy; McAndrews, Held & Ltd.

[57] ABSTRACT

An item of lower body golf wearing apparel to which certain golf tools necessary and/or desirable for the game are attached. The garment can be in the form of a skort, skirt, shorts, pants or dress. The tools attached are: 1) a stroke counter, 2) a tee pocket with tee loops, 3) a ball marker, 4) a back pocket wide enough to hold a golf glove, and/or 5) two side pockets containing an elasticized sub-pocket in each, in which golf balls may be stacked.

10 Claims, 1 Drawing Sheet

LOWER BODY GOLF UTILITY GARMENT

FIELD OF THE INVENTION

The present invention relates generally to a lower body golf garment that is both functional and stylish. The functional aspect of the garment relates to its incorporation of tools or accessories that are necessary and/or desirable for the game of golf. More specifically, the invention relates to a lower body golf garment containing 1) a stroke counter (detachable), 2) a tee pocket with tee loops, 3) a ball marker, 4) a back pocket wide enough to hold a golf glove, and/or 5) two side pockets containing an elasticized sub-pocket in each, in which multiple golf balls are stacked.

BACKGROUND OF THE INVENTION

Myriad golf garments and accessories are available to male golfers. Few, it is believed, include golf tools and accessories. Furthermore, the selection of golf garments and accessories for women is considerably limited. At the same time, more and more women are playing golf. Therefore, a need exists for golf apparel, especially for women.

Furthermore, women golfers, it is believed, have a significant desire to look stylish while playing golf. Women golfers also, I have found, enjoy the convenience of readily accessible golf tools, like ball markers, ball holders, tees, stroke counters, etc. Therefore, a need exists, especially for women, for stylish golf clothing which includes conveniently located golf accessories in a stylish manner.

Various patents and literature exist showing garment designs by which certain golf accessories are affixed or affixable to garments or the body. None exists, however, that: i) affixes a stroke counter to the garment, ii) affixes a ball marker to the waist area of the garment, iii) contains a pocket with multiple golf tee loops that is located near the waist area of the garment, iv) contains a back pocket of the width necessary to hold a golf glove, and v) contains a sub-pocket within each side pocket that is specifically designed to hold two golf balls in vertical fashion, and from which balls may be easily retrieved.

U.S. Pat. No. 5,517,696 to Krugler, titled "Multiple Compartment Garment Accessory Pocket," shows an exterior pocket that is designed to be permanently affixed to golf shorts or pants, or a shirt or jacket, and holds the following golf accessories: golf score card; pencil; golf tees; green repair tool; and ball marker. Unlike the present invention, on which the various golf tools are placed in a balanced, attractive manner, the pocket shown in '696 is not only bulky, but is unappealing as it is entirely exposed. Moreover, it lacks a stroke counter, a slit tee pocket and sub-pockets that hold two golf balls vertically, and is specifically designed to be placed away from the waist.

U.S. Pat. No. 3 ,968,522 to Riess, titled "Golf Ball Pocket and Improved Golf Garment," shows an exterior pocket designed to hold several golf balls and golf tees. The pocket features cut-out holes at the lodging point of each golf ball, so that the condition of each ball is visible at all times. The pocket may be permanently affixed to the exterior of an item of golf apparel if desired. As with the '696 pocket, the '522 pocket is aesthetically unappealing and is placed away from the waist. In addition it lacks a stroke counter, ball marker and slit tee pocket.

Several patents exist showing free-standing devices that hold various golf accessories, which devices are temporarily attachable to an item of golf apparel, usually by a pants clip. These include U.S. Pat. No. 4,129,237 to Grinder, titled "Golfer's Aid," showing a flexible plastic pouch-like holder for golf tees and a divot repair tool, with a ball marker snap fastened to the exterior. A spring clip is secured to the rear of the pouch, permitting it to be secured to the edge of golfing apparel. U.S. Pat. No. 4,886,196 to Plummer, titled "Body Worn Golf Accessory Device," is a further extension on the idea of being able to organize and easily transport golf accessories. This device is also adapted to be worn on the body by means of a pants clip, and carries golf tees, golf balls, green tools and a ball marker. The '196 device is particularly problematic, however, because the golf ball holder is a flexible pouch that hangs off of the device, and thus would swing freely as the wearer makes her golf swing, which is an annoyance.

U.S. Pat. No. 5,494,202 to Wyatt, titled "Golf Accessory Holder," also holds golf balls, golf tees and other golf accessories in a rigid, off-body device that is mountable to a belt. U.S. Pat. No. 4,893,739 to Conner, titled "Pocket for Golf Accessories," holds similar items and is mountable to a belt, but is made of a soft material so that it conforms more readily to the user's body. U.S. Pat. No. 4,736,877 to Clark, titled "Golf Accessory Holder," shows a metal device for holding a ball marker, green repair tool and golf tees, which device has a pants clip.

U.S. Pat. No. 4,625,862 to Clayton, titled "Support Assembly for Golfing Accessories," shows a device designed to hold various golf accessories, such as golf towels, club head covers and golf tees. The device is primarily intended to be attached to a golf bag.

With regard to the golf ball marker in particular, U.S. Pat. No. 5,282,616 to Stacavich-Notaro, titled "Golf Ball Marker," shows a golf ball marker with disk shaped top and bottom pieces, the bottom piece comprised of a hook and binder mating material. The top piece has a post at its center, which may be put through the user's clothes and attached to the bottom piece. While similar in purpose to the golf ball marker attached to the present invention, it is not permanently attached to an item of wearing apparel and is in fact an isolated object.

U.S. Pat. No. 4,530,500 to Kaymen, titled "Golf Ball Position Marker and Storage Device," shows a coin sized golf ball marker which is stored in a magnetized knob and hole arrangement, which is in turn lodged in a clip device, affixable to the waist area of a piece of apparel. The '500 marker is likewise an isolated object, and of course is comprised of a different mating system, i.e. magnetism, than the ball marker on the present invention.

Also distinguishable from the present invention is U.S. Pat. No. 5,569,103 to Sihn, titled "Golf Ball Marker." The '103 patent shows an ornamental, disk-shaped golf ball marker formed of or plated with a precious metal, which can be worn as an item of ornamental jewelry when not in use as a ball marker. U.S. Pat. No. 5,135,220 to Baldoni, shows a wrist-worn magnetically housed golf ball marker, clearly different from the present invention.

Turning to the stroke counter, several variations on this idea have been patented. Two such patents include U.S. Pat. No. 4,912,307 to Shade et al., titled "Device for Keeping Score During a Scoring Game," and U.S. Pat. No. 4,210,093 to Baker, titled "Counting Device." Both the '307 patent and the '093 patent are bead-type devices, attachable to an item of wearing apparel, golf bag, wrist, etc. They in fact appear to be almost identical to each other. The beads are strung in a serpentine manner on first and second portions of string, such that the first and second portions of string overlap one another in the passage of each bead. This design allows a bead that is moved to maintain its new position. The present invention contains a bead-type stroke counter, but of a less cumbersome design, and which can be affixed to the lower body garment in an attractive way and at an easily accessible location, unlike Shade and Baker.

Other stroke counting devices include U.S. Pat. No. 5,550,884 to Berney, titled "'Golf Counter' Device and Watch Combined with Such a Device," which shows an electronic, analogue display golf stroke counter. This is not analogous to the mechanical bead counter attached to the present invention, and moreover, is not attachable to an item of wearing apparel.

U.S. Pat. No. Des. 360,595 to Lia, titled "Golf-Hitting Counter," shows an ornamental design for a golf-hitting counter, comprised of a boxy looking structure with a pants clip and display screen. U.S. Pat. No. 4,998,726 to Budnick, titled "Accessory for Golfers," shows a self-contained, rectangular case having a circular rotatable stroke counter, a retractable cleaning tool, a ball marker, an information display surface, and an eyelet to secure the device to a golf bag or key chain. U.S. Pat. No. 4,922,850 to Conley, titled "Golf Glove with Stoke Counter," shows a golf glove with a golf stroke counter mounted on the back thereof, which includes a cursor that can be moved to positions designating the specific number of strokes taken. U.S. Pat. No. 4,864,592 to Lee, titled "Golf Score Counter," shows a relatively sophisticated electronic golf score counter for counting each fairway and putting stroke, totaling individual hole scores, scores for the front and back nine, and scores for the full 18 holes. U.S. Pat. No. 5,471,191 to Narita, titled "Golf Score Display Device," shows a similarly sophisticated wrist-worn golf score keeping device. The golfer presses a button on '191 every time she makes a stroke, and the totals are stored for later retrieval of the score for all holes. These electronic devices do not appear to be analogous to the mechanical aspects of the present invention integrated into a stylish golf garment.

Finally, with regard to tee holders, U.S. Pat. No. 5,056,697 to Sheffield, titled "Golf Tee Holder," and U.S. Pat. No. 4,336,940 to Sprague, also titled "Golf Tee Holder," show freestanding golf tee holders made of a rigid material. The present invention is an improvement over '697 and '940 as the tee loops on the present invention are attached to the garment itself, in way that is discreet, easily accessible and out of the way of the swing plane.

As evidenced by the above, there continues to be a need for a way to integrate golf accessories into stylish, comfortable wearing apparel in an aesthetically pleasing, balanced manner which does not interfere with the player's golf game.

SUMMARY OF THE INVENTION

There is a great need for stylish garments, on which means exist to carry tools that are necessary and/or desirable for the game of golf. Without such garments, one must carry all tools in his or her pocket, which is generally the pocket on the side of one's dominant hand, or in one's golf bag where they are not readily accessible. The result is a crowded, bulky pocket in which one must search for each tool as it is needed. Not only is this uncomfortable and unsightly, it results in much more time spent locating the needed tool than proceeding with the round of golf. This inhibits speed-of-play, which is fundamental in the game of golf.

The present invention solves these problems by providing a way to organize such tools on the item of apparel itself, in a balanced, stylish and readily accessible manner. The tools are attached to the garment in such a way that they are easily accessible, do not inhibit the free range of motion needed for the golf swing, and are either hidden from other people's view or are placed on the garment so that they are aesthetically pleasing. This creates style and comfort both on the course, and when wearing the item during pre- and/or post-round activities. In today's busy world, people have less time and desire to change their clothes often throughout the day.

Specifically, the present invention provides a lower body golf garment that is both functional and stylish. It may contain one or more of several tools that are necessary and/or desirable when playing golf. These tools include: 1) a stroke counter (detachable); 2) a tee pocket with tee loops; 3) a ball marker; 4) a back pocket wide enough to hold a golf glove; and/or 5) two side pockets containing an elasticized sub-pocket in each, in which multiple golf balls may be stacked.

With regard to each tool in particular, a stroke counter is highly desirable, particularly for higher handicappers. Just keeping count of one's strokes can be a challenge. Golf is largely a mental game, and worrying about what stroke you are hitting greatly detracts from one's focus. The stroke counter is detachable, so that the garment may be washed without affecting the stroke counter, or the garment may be worn without the counter if desired. When affixed to the garment, the cord on which the counting beads are strung is taut, and the cord is of sufficient width to create the friction necessary to prevent the beads from sliding over independently of intentional movement by the garment wearer.

Turning to the tee loops and pocket, tees are the standard mechanism for raising the ball off of the ground on one's first shot on a hole. It is undesirable to be slowed down by having to search through a crowded pocket for a tee. The tee loops located within the slit pocket, at the waist area of the garment, will provide a convenient and aesthetically pleasing way to organize this item. The slit pocket serves two purposes: a) it provides an alternative for persons who do not wish to use the actual tee loops, and b) it provides a shield from the dirtied surface of the garment that will result from tees being placed in the ground and then in the loops/pocket.

The ball marker is also a necessary part of the game of golf, as one must remove her ball from the putting green if it is in another's line of play, will distract another player or needs to be cleaned. Ball markers are generally quite small, and will often fall to the bottom corner of one's pocket, making the marker particularly difficult to retrieve in a short amount of time—especially when the pocket is stuffed with several other tools as well. The present invention eliminates this problem by placing the marker, by a snap fastener apparatus, on the waist area of the garment. This way, the marker is always within easy reach, for both retrieval and replacement. Furthermore, the ball marker is placed on the present invention in such a way that it will not interfere with the golf swing, and is preferably made of a noncorrosive material, such as plastic or stainless steel.

The golf glove is used by most golfers. A large number of golfers, however, remove their glove when they putt. Stuffing the glove into one's pocket is not the most desirable alternative because the added bulk can interfere with the putting stroke. This is especially the case when the pocket contains so many other items already. A more desirable place to put the glove is in a back pocket. The back pocket of the presentation invention is designed specifically to be wide enough for a golf glove.

The sub-pocket in each side pocket of the present invention is designed to hold two golf balls vertically. It is more aesthetically pleasing to have the balls sit in the pocket vertically, rather than horizontally. The sub-pockets are made of an elasticized material, which makes the retrieval of a ball easy and fast. Moreover, the sub-pockets provide a means of organizing the pockets, if one wishes to carry additional items in the pocket(s).

DESCRIPTION OF THE DRAWINGS

FIG. 2 also exhibits the ball marker, showing how the marker itself can be removed from its affixed base.

FIG. 5 also is a perspective of the back pocket, which is specifically designed to be wide enough to hold a golf glove.

DESCRIPTION OF THE PREFERRED EMBODIMENT

Figure 1:
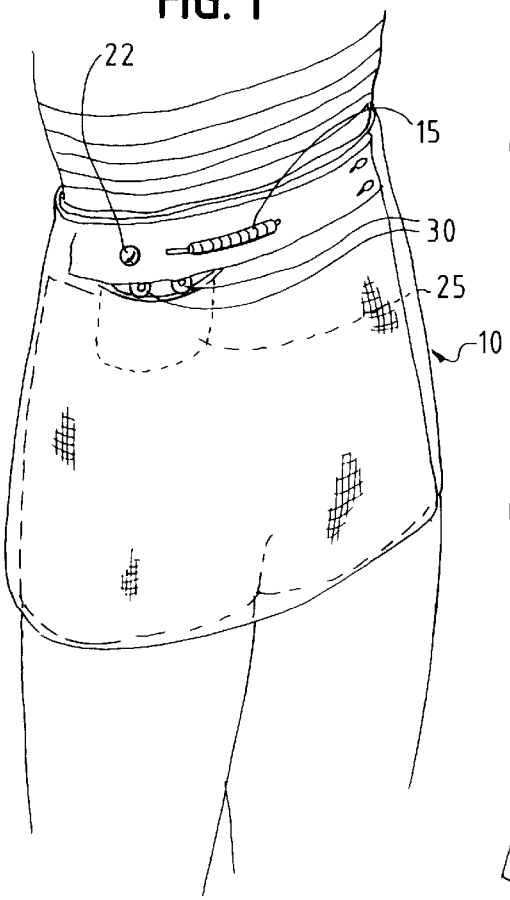
FIG. 1 is an on-body perspective view of the functional aspects of the present invention incorporated into a lower body garment. Visible from the front view are the stroke counter, tee pocket, and ball marker.
Figure 2:
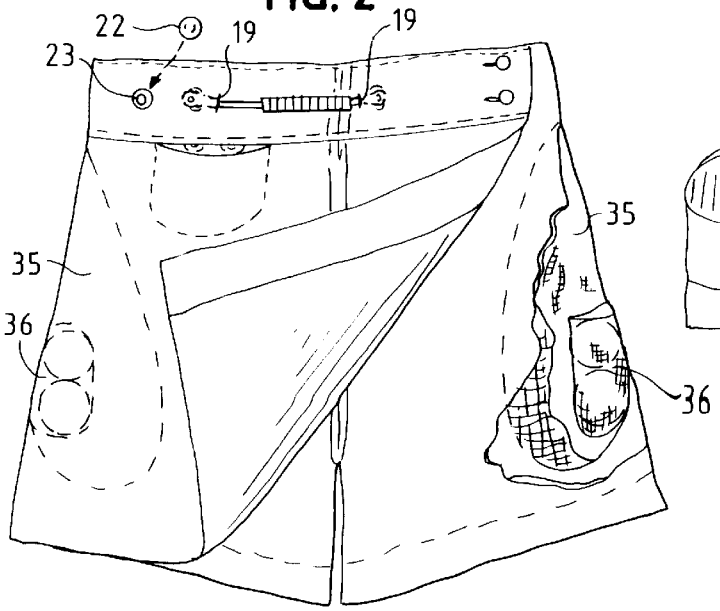
FIG. 2 is an off-body, partially cut-away front view of the invention, exhibiting the garment's two side pockets, which each contain a sub-pocket in which two golf balls stack vertically.

FIG. 1 (on-body) and FIG. 2 (off-body) are front views of the invention, exhibited in this case as a skort, and designated generally 10. While the invention is shown as a skort, it will be understood that it could exist as pants, shorts or a dress. From the front view, the visible tools include stroke counter 15, ball marker 22 and small "slit" pocket 25.

Figure 3:
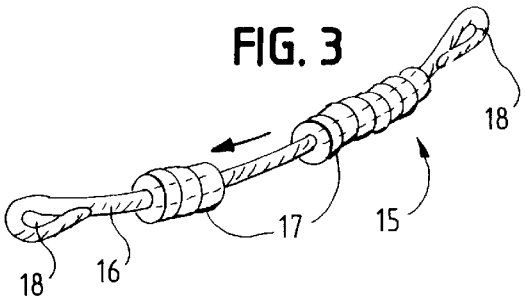
FIG. 3 is an isolated view of the stroke counter, which is attached to the front of the garment at the waist area.

FIG. 3 shows an isolated view of stroke counter 15. Stroke counter 15 is made of a cord 16 of a durable material, including but not limited to cotton, leather and/or silk, on which ten beads 17 are strung. Beads 17 are ideally plastic. Cord 16 of stroke counter 15 is of a sufficient diameter to interact with a diameter of the bore of the beads 17 to create the friction necessary to prevent beads 17 from moving independently of the wearer's intentional movement. Loops 18 are formed at each end of stroke counter 15, which one may insert through two slits 19 on the garment's waist area and loop over buttons 20 attached to the inside of the garment's waist area, shown in FIGS. 2 and 5, and thereby affix the stroke counter to the garment. Of course, stroke counter 15 could be attached by means of hook and loop fasteners, snaps, etc., although the described means are believed to be preferable.

Ball marker 22, shown in FIGS. 1 and 2, is a snap fastener apparatus, the top portion of which is a disc having a protruding stud on its bottom side. The marker 22 is releasably attached to the garment at or near the waistband, as seen in FIGS. 1 and 2. A retainer 23 is fixedly attached to the waistband area. Retainer 23 includes a central aperture through which the stud of marker 22 is put when securing marker 22, as is commonly known. Retainer portion 23 of the snap apparatus is permanently affixed to the waist area of the garment.

The golf garment of the present invention also includes tee holders. There are at least two tee loops 30 attached to the waist area of the garment, at or near the location of the slit pocket. As shown in FIGS. 1 and 2, tee loops 30 are not visible to the observer. They are made of a durable cord, and form a loop of a sufficient diameter to hold a tee snuggly, but which will allow for easy removal of the tee. One may insert tees into the loops, and/or insert tees directly into the slit pocket.

Two side pockets 35 are shown in FIG. 2, each of which contains a sub-pocket 36, made of an elasticized material, in which two balls may be stacked vertically, and from which the balls may be easily retrieved. Sub-pockets 36 therefore maintain extra golf balls readily accessible but without allowing the golf balls to flap around. Further, a pocket 35 and subpocket 36 on each side allows any golfer, whether right-handed or left-handed, easy access.

Figure 4:
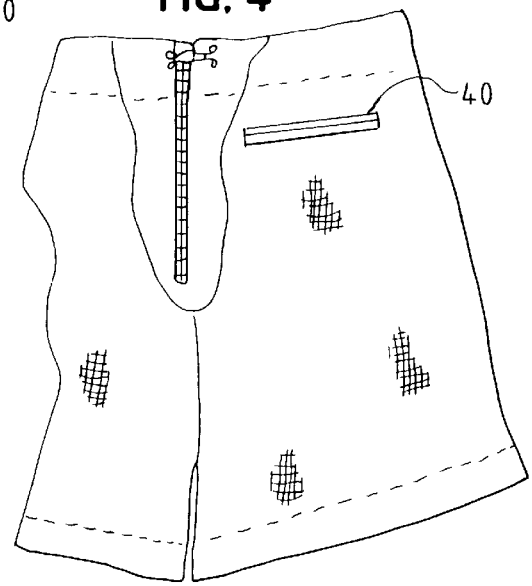
FIG. 4 is a back partially cut-away view, showing the garment fastener from an inside perspective.
Figure 5:
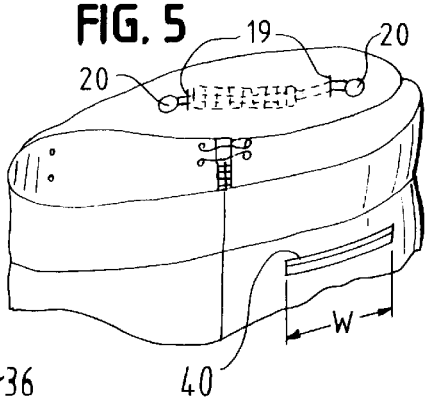
FIG. 5 shows the stroke counter from an inside perspective, and displays the way in which the stroke counter is attached to the garment by inside buttons.

FIGS. 4 and 5 each show the zipper and clasp fasteners for this particular garment. It will be understood, however, that each type of garment may have different fasteners, i.e. buttons, zippers, snaps, etc.

FIG. 5 also shows the garment's back pocket 40, which is specifically designed to be wide enough to hold a golf glove.

Of course, it should be understood that various changes and modifications to the preferred embodiments described herein will be apparent to those skilled in the art. Other changes and modifications, such as those expressed here or others left unexpressed but apparent to those of ordinary skill in the art, can be made without departing from the spirit and scope of the present invention and without diminishing its attendant advantages. It is, therefore, intended that such changes and modifications be covered by the following claims.

I claim:

1. A lower body garment comprising a waistband and material depending from the waistband comprising:

a stroke counter attachable to the garment comprising a cord and a plurality of beads movably residing on the cord;

a ball marker assembly comprising a ball marker having a flat head and central detent and a retainer permanently affixed to the garment for releasably receiving the ball marker detent;

a pocket having an opening near the bottom of the waistband and of sufficient size to store golf tees.

2. The garment of claim 1 wherein the stroke counter cord has a general diameter and the plurality of beads each has a central aperture having a sufficient diameter to reside on the cord and resist unintended movement and further comprises a loop at either end for releasably fastening to buttons affixed to an inside of the waistband.

3. The garment of claim 2 further comprising a waistband having two apertures therein, one proximate each button, for threading the cord through before attachment to the buttons.

4. The garment of claim 1 further comprising a plurality of loops of material attached near the waistband and having sufficient size to hold a golf tee securely.

5. The garment of claim 4 wherein the tee loops are situated about the pocket.

6. The garment of claim 1 further comprising two hand pockets situated generally on the sides of the garment, said hand pockets including a sub-pocket comprised of resilient material and able to store a plurality of golf balls stacked vertically.

7. The garment of claim 1 comprising a skort.

8. The garment of claim 1 comprising shorts.

9. The garment of claim 1 comprising a skirt.

10. The garment of claim 1 comprising pants.

* * * * *